United States Patent [19]

Yoshimura

[11] Patent Number: 4,955,837

[45] Date of Patent: Sep. 11, 1990

[54] COOLING WATER FEED STRUCTURE FOR INBOARD/OUTBOARD ENGINE

[75] Inventor: Tsuyoshi Yoshimura, Hamamatsu, Japan

[73] Assignee: Sanshin Kogyo Kabushiki Kaisha, Hamamatsu, Japan

[21] Appl. No.: 290,444

[22] Filed: Dec. 27, 1988

[30] Foreign Application Priority Data

Dec. 28, 1987 [JP] Japan ..... 62-329646

[51] Int. Cl.[5] ..... B63H 21/10

[52] U.S. Cl. ..... 440/88

[58] Field of Search ..... 440/57, 88, 89, 111-113; 123/41.14, 41.15

[56] References Cited

U.S. PATENT DOCUMENTS 3,181,495 5/1965 Kiekhaefer ..... 440/57

4,699,598 10/1987 Bland et al. ..... 440/88

*Primary Examiner*—Joseph F. Peters, Jr.

*Assistant Examiner*—Jesûs D. Sotelo

*Attorney, Agent, or Firm*—Ernest A. Beutler

[57] ABSTRACT

A number of embodiments of cooling water feed structures for inboard/outboard engines wherein the outboard drive includes a first conduit that extends through the outboard drive and communicates with an adjustably mounted second conduit. The adjustable mounting of the second conduit adapts it to use with any of a plurality of engine types having different water inlet locations.

4 Claims, 4 Drawing Sheets

COOLING WATER FEED STRUCTURE FOR INBOARD/OUTBOARD ENGINE

BACKGROUND OF THE INVENTION

This invention relates to a cooling water feed structure for an inboard/outboard engine and more particularly to a cooling water conduit for an inboard/outboard engine that is adaptable to a wide variety of engines and engine constructions.

The inboard/outboard drive for watercraft is very popular and highly versatile. With such an arrangement, an outboard unit, much like an outboard motor albeit without the powering internal combustion engine, is mounted on the rear side of the transom of the watercraft and includes a propulsion device that is driven by an internal combustion engine positioned within the hull of the watercraft. A wide variety of engines and engine types are utilized for powering such systems.

In connection with these arrangements, it is the normal practice to circulate cooling water from the body of water in which the watercraft is operating from the lower unit of the outboard drive to the engine and then return it back to the body of water through the outboard drive. In accordance with this type of arrangement, it is necessary to provide a fluid path between the lower unit and the engine. Normally, the water inlet and water outlets of the outboard drive portion are located in the same location regardless of the engine which is utilized. However, various engines have various locations for their water fittings and particularly the water inlets. As a result, it is necessary for prior art constructions to provide specific conduits which can be utilized to adapt the outboard drive unit to a specific engine. This, of course, increases the number of parts that must be stocked and also gives rise to possible error.

It is, therefore, a principal object of this invention to provide an improved arrangement for conveying cooling water between an outboard drive and an engine and which is adaptable to a wide variety of engine types.

It is a further object of this invention to provide an outboard drive unit having a water conduit arrangement that is adaptable to a wide variety of engines without necessitating the use of separate parts.

It is a further object of this invention to provide an improved water inlet system for conveying water from the outboard drive unit to a wide variety of engine locations without necessitating separate parts for each location.

SUMMARY OF THE INVENTION

This invention is adapted to be embodied in a cooling water system for a marine outboard drive that is comprised of an outboard drive unit adapted to be mounted on the transom of a watercraft and carrying a propulsion unit that is adapted to be driven by any of a plurality of engines positioned within the hull of an associated watercraft. A water opening is formed in the outboard drive and a first conduit formed in the outboard drive extends therethrough between the water opening and an end contiguous to the transom. In accordance with the invention, a second, rigid conduit communicates at one end with the first conduit transom and means mount the rigid conduit for movement of its other end between at least two different positions for communication with two different engine water connections with the one end communicating with the transom end of the first conduit in either position.

DETAILED DESCRIPTION OF THE PREFERRED EMBODIMENTS

Figure 1:
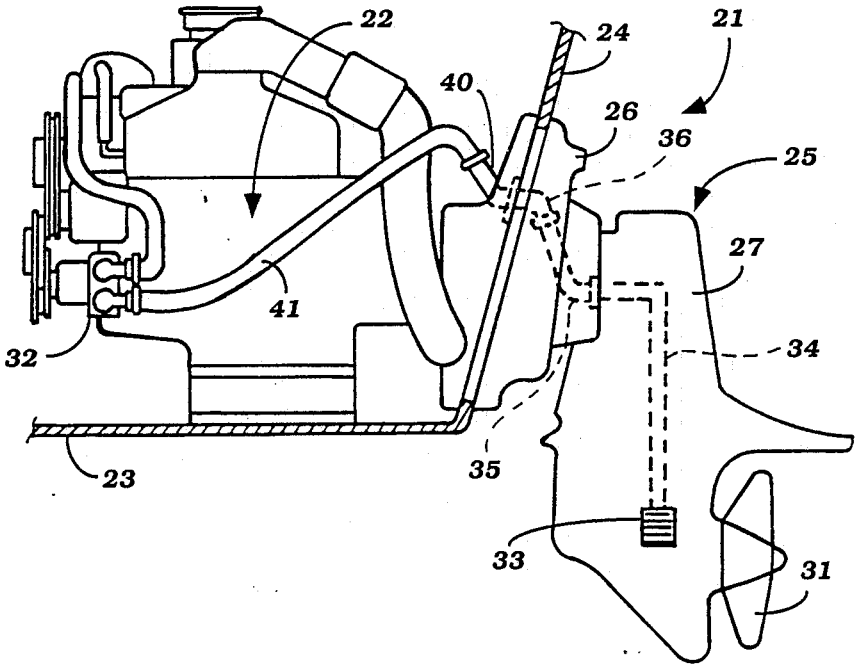
FIG. 1 is a side elevational view of a portion of a watercraft, shown in section, constructed in accordance with a first embodiment of the invention.
Figure 2:
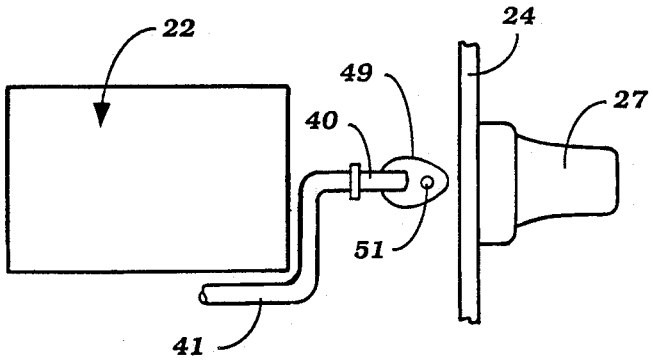
FIG. 2 is a partial top plan view, with parts shown schematically, showing the arrangement of conveying water to the engine.

Referring first to FIG. 1, an inboard/outboard drive constructed in accordance with an embodiment of the invention, is identified generally by the reference numeral 21. The inboard/outboard drive 21 includes an internal combustion engine 22, which may be of any known type and which is mounted within a hull 23 of a watercraft forwardly of its transom 24. In accordance with the invention, the construction of the unit permits its utilization with a wide variety of engine types.

An outboard drive portion of the unit is indicated generally by the reference numeral 25 and includes a gimbal housing 26 that is affixed to the rear side of the transom 24 in a known manner. The gimbal housing 26 mounts an outboard drive unit 27 for steering movement about a vertically extending axis and tilt and trim movement about a horizontally extending axis in a conventional manner.

The engine 22 drives an input shaft 28 (FIG. 3) that extends through the transom 24 and is connected by means of a universal joint assembly 29 to a drive system including a forward, neutral, reverse transmission (not shown) mounted in the outboard drive unit 27 for driving a propulsion unit such as a propeller 31. The construction as thus far described may be considered to be conventional and, for that reason, further description of the details is not believed to be necessary.

The engine 22 is provided with a cooling system of the water cooled type. Normally, the engine 22 will be of an automotive type of engine that has been marinized in a suitable manner. It is to be understood, however, that the invention may be utilized in conjunction with any type of water cooled engine. The engine cooling system includes a circulating pump 32 that is driven by the engine in a suitable manner and which circulates coolant through the engine cooling jacket for discharge back into the body of water in which the watercraft is operating along with the exhaust gases from the engine. Since this water discharge system does not embody the invention in this embodiment, description of it is not believed to be necessary.

The invention, however, resides in the manner for delivering water from the body of water in which the watercraft is operating to the coolant pump 32. This system includes an under water inlet 33 that is formed in the lower unit of the outboard drive unit 27 and which communicates with an internal passageway 34 that is formed within the housing of the outer unit 27 by means of an integral passageway.

Figure 3:
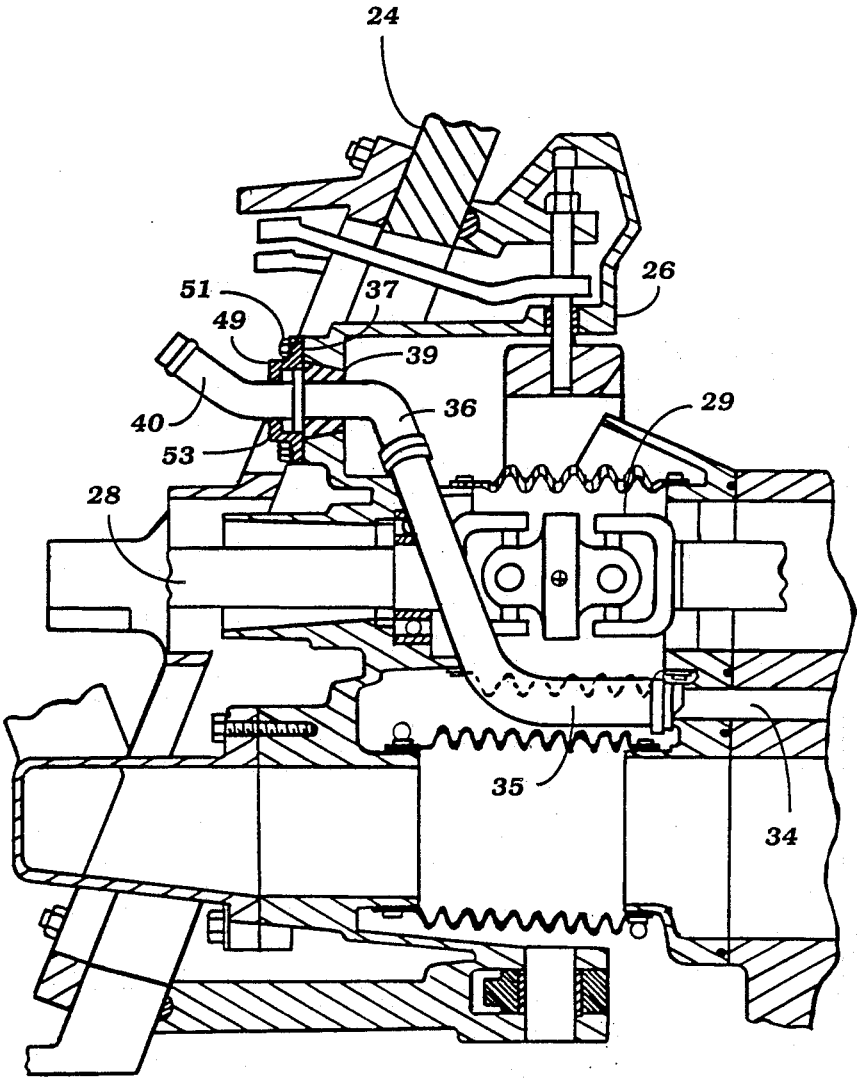
FIG. 3 is an enlarged cross-sectional view taken through the transom and showing the construction of the water conduitry therefor.
Figure 4:
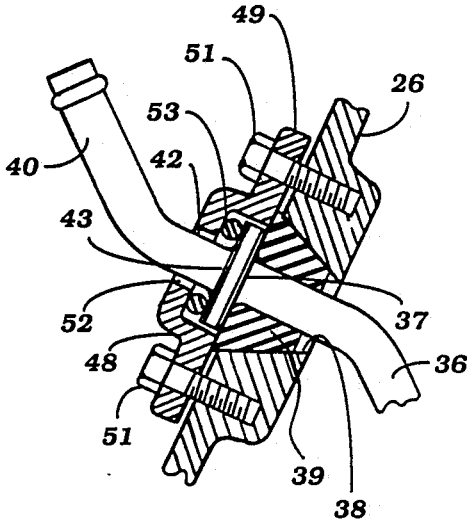
FIG. 4 is an enlarged cross-sectional view showing the water conduit joint.
Figure 5:
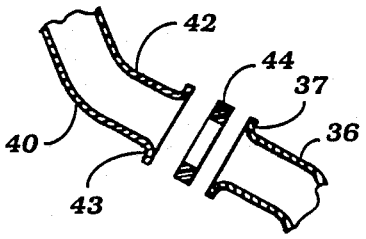
FIG. 5 is a partially exploded cross-sectional view of the water joint.
Figure 6:
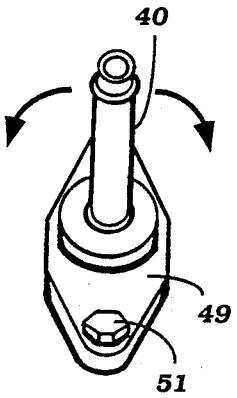
FIG. 6 is a rear elevational view of the water joint showing how it is adjustable.

Referring now in detail to the remaining figures and initially primarily to FIG. 3, the internal passageway 34 delivers water to a first rigid conduit 35 that is mounted within the outboard drive unit 25. The conduit 35 is connected to or formed integrally with a second conduit 36 that has an end portion 37 that is disposed immediately adjacent the transom 24. The end portion 37 is, in the illustrated embodiment, of a flanged configuration and is received within an opening 38 formed in the gimbal housing 26 and which is located by an elastic sealing ring 39.

An adjustable second rigid conduit 40 has an adjustable connection to the conduit 36, of a type which will be described, and has a flanged end portion that receives a flexible conduit 41 for conveying water to the water pump 32. In order to permit the use of a single type of connection for a variety of engines, the rigid conduit 40 is made adjustable in a way which may be best seen by reference to FIGS. 3 through 6.

To permit this adjustment, the conduit 40 is formed with a generally cylindrical portion 42 that has a flanged end 43 that is adapted to communicate with the conduit end 37 with an interposed sealing gasket 44. The gasket 44 and conduit flanges 43 and 37 are held in sealing engagement by means of cover plate 49 that is bolted to the gimbal housing 26 by means of bolts 51. The cover plate 49 has an enlarged opening 52 that clears the cylindrical conduit portion 42 and an O-ring seal 53 is interposed between the cover plate 49 and the flange 43 so as to effect fluid tight sealing. As may be seen in FIG. 6, the position of the flanged end of the rigid conduit 40 may be easily adjusted by releasing the tension on the bolts 51 and rotating the conduit 40 about the cylindrical section 41. When the desired position is reached, the cylindrical section and conduit 40 are locked in position by retightening the bolt 51. Therefore, it should be readily apparent that the construction permits the use of a single fitting that can be used with a wide variety of engine types and engines having different water inlet locations.

Figure 7:
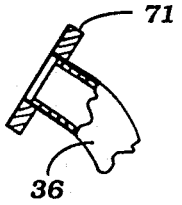
FIG. 7 is a cross-sectional view showing an alternative construction for the first conduit of the outboard drive unit.
Figure 8:
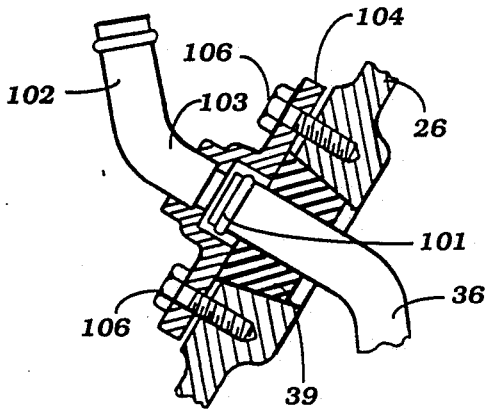
FIG. 8 is a cross-sectional view, in part similar to FIG. 4, showing another embodiment of the invention.
Figure 9:
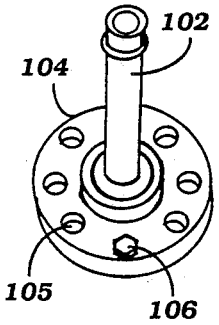
FIG. 9 is a front elevational view showing this other embodiment in the first position.
Figure 10:
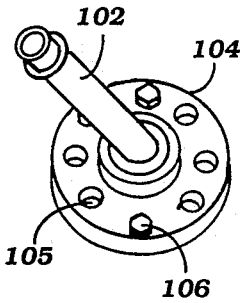
FIG. 10 is an elevational view showing this embodiment in a second position.
Figure 11:
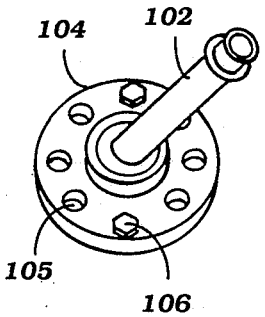
FIG. 11 is an elevational view showing this embodiment in a third position.

In the embodiment of FIGS. 1 through 6, the rigid conduit 36 was formed with an integral flange 37. FIG. 7 shows another embodiment wherein a welded on flange 71 is employed.

FIGS. 8 through 11 show another embodiment of the invention. In this embodiment, the rigid conduit 36 and its mounting in the gimbal housing 37 is substantially the same as in the previously described embodiment. However, in this embodiment, the end of the conductor 36 is formed with an integral flange 101 that may be formed by upsetting a portion of the conduit 36. In this embodiment, a further rigid conduit 102 has an end portion 103 that is rigidly affixed within a flange 104 that has a plurality of bolt receiving openings 105 to receive bolts 106 for securement to the outboard drive housing 26. The elastic sleeve 39 achieves sealing between the flange 104 and thus further O-ring seals are not required in this embodiment. As may be seen in FIGS. 9 through 11, by removing the bolts 106 and rotating the entire flange 104, it is possible to change the angular position of the rigid conduit 102 relative to the outboard drive housing 26 so as to adapt to a wide variety of engine types and water inlet locations.

It should be readily apparent from the foregoing description that the embodiments of the invention are particularly adapted for facilitating the conversion of a single type of outboard drive unit to mate with a number of different engine types having different water inlet locations. Additional or separate fittings to achieve these results are not required.

Although a number of embodiments of the invention have been illustrated and described, various changes and modifications may be made without departing from the spirit and scope of the invention, as defined by the appended claims.

I claim:

1. In a cooling water system for a marine outboard drive comprised of an outboard drive unit adapted to be mounted on the transom of a watercraft and carrying a propulsion unit adapted to be driven by any one of a plurality of engines positioned within the hull of the associated watercraft, at least two of the engines having water connections at different locations relative to the transom when mounted therein, a water opening formed in said outboard drive unit, and a first conduit formed in said outboard drive unit and extending therethrough between said water opening and an end contiguous to said transom, the improvement comprising a second, rigid conduit communicating at one end with said first conduit transom end and means for mounting said rigid conduit for rotational movement of the other of its ends between at least two different angular positions for communicating with either selected one of the two different engine water connections with the one end thereof communicating with the transom end of said first conduit in either position.

2. In a cooling water system for a marine outboard drive comprised of an outboard drive unit adapted to be mounted on the transom of a watercraft and carrying a propulsion unit adapted to be driven by any of a plurality of engines positioned within the hull of the associated watercraft, at least two of the engines having water connections at different locations relative to the transom when mounted therein, a water opening formed in said outboard drive unit, and a first conduit formed in said outboard drive unit and extending therethrough between said water opening and an end contiguous to said transom, the improvement comprising a second, rigid conduit communicating at one end with said first conduit transom end and means for mounting said rigid conduit for movement of the other of its ends in a plurality of positions relative to said first conduit for communicating with either selected one of the two different engine water connections with the one end thereof communicating with the transom end of said first conduit in a selected one of the plurality of positions.

3. In a cooling water system as set forth in claim 2 wherein the second conduit comprises a cylindrical end portion journaled within a housing adapted to be affixed relative to the first conduit for adjustment of the second conduit relative to the first conduit.

4. In a cooling water system as set forth in claim 2 wherein the second conduit is affixed to a flange having a plurality of mounting openings for attachment to the first conduit in various angular positions.

* * * * *